United States Patent [19]

Tolf

[11] Patent Number: 5,016,667

[45] Date of Patent: May 21, 1991

[54] DEVICE FOR A DISH-WASHER

[75] Inventor: Anders K. H. Tolf, Jönköping, Sweden

[73] Assignee: Aktiebolaget Electrolux, Stockholm, Sweden

[21] Appl. No.: 611,445

[22] Filed: Nov. 8, 1990

Related U.S. Application Data

[63] Continuation of Ser. No. 472,579, Jan. 30, 1990, abandoned.

[30] Foreign Application Priority Data

Feb. 7, 1989 [SE] Sweden ..... 8900407

[51] Int. Cl.[5] ..... A47L 15/42; F04F 10/00

[52] U.S. Cl. ..... 137/143; 68/208; 134/186; 137/216

[58] Field of Search ..... 68/208; 134/186, 155; 137/143, 215, 216

[56] References Cited

U.S. PATENT DOCUMENTS 3,346,000 10/1967 Cushing ..... 134/186 X 3,349,579 10/1967 Geschka et al. ..... 68/208 X

*Primary Examiner*—Philip R. Coe

*Attorney, Agent, or Firm*—Pearne, Gordon, McCoy & Granger

[57] ABSTRACT

A device for a dishwasher comprising a tub (10) in which liquid is circulated for cleaning the dishes. The dishwasher has a drain pump (14) with an inlet which is placed adjacent the bottom of the tub and a conduit (16) which is connected to the outlet (15) of the pump through which the liquid is emptied from the machine. The conduit comprises an ejector (17) through which the liquid flows during emptying, the suction side of the ejector being connected to the tub.

3 Claims, 1 Drawing Sheet

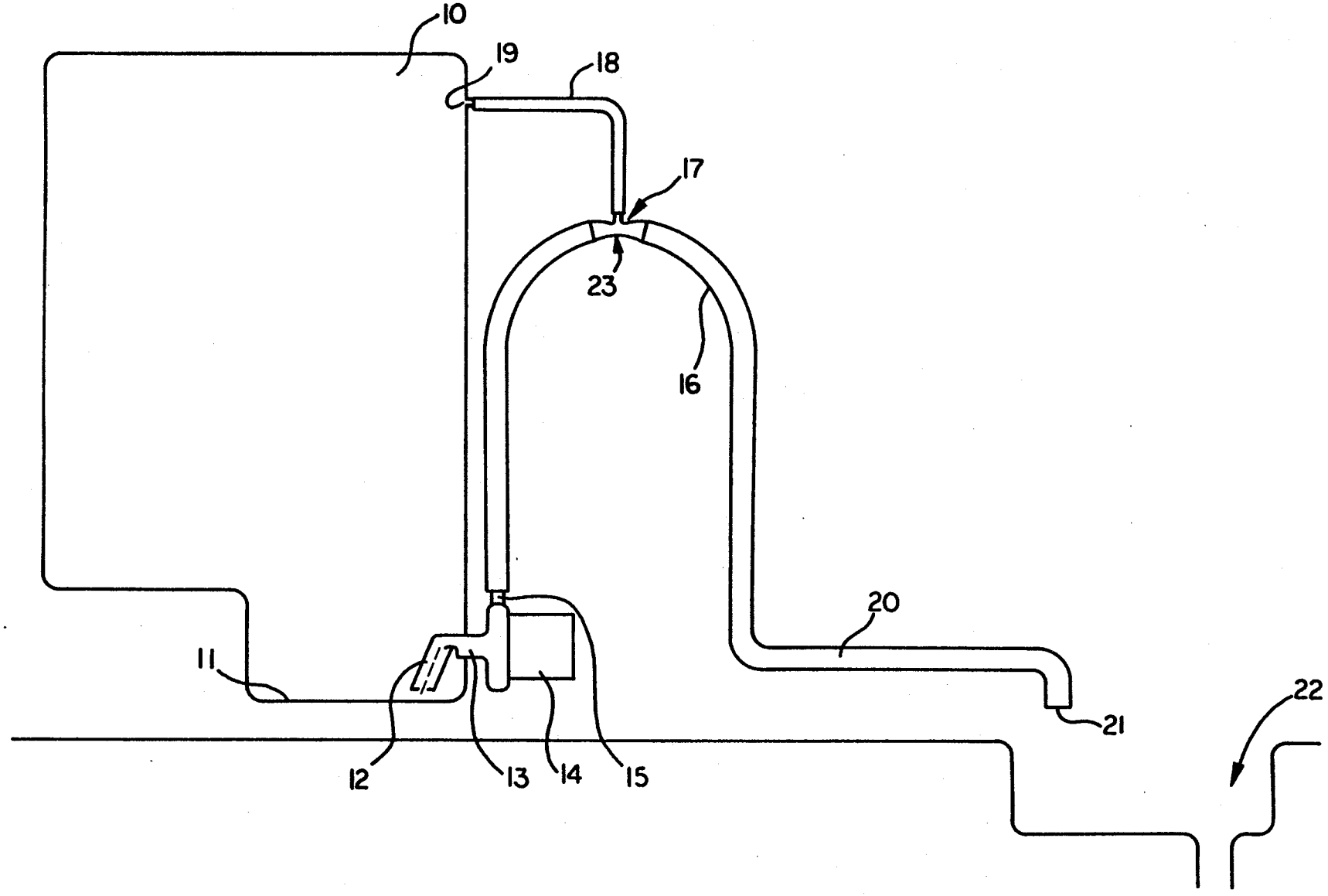
10
11
12
13
14
15
16
17
18
19
20
21
22
23

DEVICE FOR A DISH-WASHER

This is a continuation of application Ser. No. 472,579, filed on Jan. 30, 1990, and now abandoned.

BACKGROUND OF THE INVENTION

The present invention relates in general to dishwashers, and more particularly to an improved device for emptying water from a dishwasher.

PRIOR ART

A dishwasher which utilizes a tub in which liquid is circulated for cleaning the dishes, a drain pump having an inlet which is placed adjacent the bottom of the tub, and a conduit connected to the outlet of the pump is known in the prior art and is used for household purposes. Such machines usually work with several successive dishwashing cycles. During a dishwashing cycle, water is taken into the tub and is circulated through nozzles onto the dishes by means of a circulation pump. The water is then recollected in a sump at the bottom of the tub and is pumped to the sewer by means of a drain pump. In order to achieve a good dishwashing result, it is necessary that almost all dishwater with its contaminating particles is emptied from the machine after each dishwashing cycle so that the dirty dishwater does not contaminate the fresh water which is taken in from the water main for the following dishwashing cycle.

The emptying system of the dishwasher described above, with the exception of the drain pump, usually comprises a hose conducting the water from the pump directly to the sewer. For dishwashers which are placed on a work top, this hose is shaped as an upside-down U, the highest point of which is situated above the highest water level in the machine. As a result, the emptying system is very simple. This arrangement results in a control function without valves or other control means by which the water is maintained in the tub during the dishwashing procedure and leaves by activating the drain pump. However, this arrangement has a few drawbacks. One drawback is that self-emptying can occur during the dishwashing procedure by means of the siphon effect, since a water column might be hanging in the hose after an emptying procedure. As a result of such a hanging water column, it can also become difficult to transport the water from the tub to the sewer if an air pocket is created in the pump or in the hose. A further drawback is that at the end of the emptying phase, a backflow of dirty dishwater might occur, which means that the complete liquid column which is present in the hose will flow back into the tub, mixing dirty water with fresh water. According to what has been said in the introduction, this is not desirable. If the dishwasher is provided with a drain pump which is placed completely or partly above the bottom of the tub, and that pump is not capable of sucking up the complete water quantity from the bottom, a problem will be presented, since dirty water will remain in the tub.

SUMMARY OF THE INVENTION

In accordance with the present invention, a device for a dishwasher, comprising a tub in which liquid is circulated for cleaning dishes, a drain pump having an inlet which is placed near the bottom of the tub, and a conduit through which the liquid is emptied from the machine, is provided. The highest point of the conduit is situated at the upper part of the machine. The conduit adjacent that highest point has an ejector through which the liquid flows during the emptying procedure and the suction side of which communicates with the tub.

One of the purposes of this invention is to create a dishwasher where the quantity of water remaining in the tub after emptying is limited, where the siphon effect is prevented, and where the air supply to the drain pump is safeguarded.

A preferred embodiment of the present invention is described in the following specification with reference to the attached drawing.

BRIEF DESCRIPTION OF THE DRAWING

The attached drawing diagrammatically shows a vertical section through a dishwasher according to the present invention.

DESCRIPTION OF THE PREFERRED EMBODIMENT

In the attached drawing, there is shown a dishwasher of the work-top type having a tub 10 in which the dishes are placed, the dishes being accessible via a lid (not shown). The tub is in the usual way surrounded by a shell (not shown) which encloses the other elements which are necessary for the function of the dishwasher. The bottom of the dishwasher has a sump 11 in which the dishwater is collected, and from which it is distributed by means of a circulation pump (not shown) to nozzles (not shown) in the tub.

From the sump 11 a tube 12 extends up to inlet 13 of a drain pump 14 situated beside the tub. The outlet 15 of the pump is connected to a drain hose 16 which is shaped as an upside-down U and which at its highest point has an ejector 17. The drain hose 16, although it is shown in the drawing perpendicular to the rear wall of the tub, is placed parallel to said wall, and preferably inside the shell. The suction side of the ejector is connected, via a hose 18, to an opening 19 in the upper part of the tub. The drain hose 16 continues into an extension 20 which has an outlet 21 which is connected to a sewage system 22.

The device operates in the following way. When filling the dishwasher with water, the water level will rise simultaneously in the pump, the drain hose and in the tub, since the pump is vented through the drain hose 16. The level in the pump and in the drain hose will then follow the level variations which are created in the tub during the dishwashing cycle. When emptying, the drain pump 14 is activated, which means that the water which is present in the sump and in the pump flows towards the outlet 21 of the drain hose.

Because of the water flow through the ejector 17, a negative pressure is created which draws air from the tub through the opening 19 and the hose 18. The negative pressure is created by the constricted throat 23 of the ejector 17 shown in the Figure. As contaminated discharge fluid flows through the ejector 17 a pressure drop is created thereby drawing air from the tub 10 through the hose 18 toward the ejector 17. Thus, contaminated water is precluded from entering the tub 10 during discharge. When the water in the dishwasher has fallen to a level where air is drawn through the tube 12, the pumping effect will cease. This, however, means that the water column which is present in the hose 16 will be forced a bit further forward in the conduit because of its kinetic energy. When the velocity of the water column ceases, the ejector will lose its sucking capability and, instead, air will leak into the ejector through the hose 18 from the tub 10. As a result, the water column which is present in the hose 16 will be divided into two smaller columns. A first water column situated to the left of the ejector in the drawing is returned as a minor remaining water quantity into the tub, while a second column situated to the right of the ejector is drained off into the sewer. Thus, the pump is vented and a siphon effect cannot be created.

Although the preferred embodiment of this invention has been shown and described, it should be understood that various modifications, replacements, and rearrangements of the parts may be resorted to without departing from the scope of the invention as described and claimed herein.

What is claimed is:

1. A device for a dishwasher comprising a tub (10) in which liquid is circulated for cleaning dishes, a drain pump (14) having an inlet which is placed near the bottom of said tub, and a conduit (16) through which the liquid is emptied from the machine, said conduit having a highest point which is situated at the upper part of the machine, wherein the conduit adjacent the highest point has an ejector (17) through which the liquid flows during the emptying procedure and the suction side of which communicates with said tub, said injector having a constricted throat (23) that creates a negative pressure when discharge water flows through said injector, said negative pressure drawing air from the tub thereby preventing any contaminated water from entering the tub during discharge.

2. A device according to claim 1, wherein said conduit (16) at least partly is shaped as an upside-down U.

3. A device according to any one of the preceding claims, wherein the suction side of said ejector (17) is connected to said tub via a hose (18), the inlet (19) of which is placed above the highest liquid level in said tub.

* * * * *